US010660392B2

(12) United States Patent
Nimura et al.

(10) Patent No.: US 10,660,392 B2
(45) Date of Patent: May 26, 2020

(54) HELMET

(71) Applicant: SHOEI CO., LTD., Tokyo (JP)

(72) Inventors: Taku Nimura, Tokyo (JP); Yoshiyuki Ikeda, Tokyo (JP)

(73) Assignee: SHOEI CO., LTD., Tokyo (JP)

( * ) Notice: Subject to any disclaimer, the term of this patent is extended or adjusted under 35 U.S.C. 154(b) by 126 days.

(21) Appl. No.: 16/145,917

(22) Filed: Sep. 28, 2018

(65) Prior Publication Data

US 2019/0335840 A1 Nov. 7, 2019

(30) Foreign Application Priority Data

May 1, 2018 (JP) ..... 2018-088176

(51) Int. Cl.
*A42B 3/22* (2006.01)

(52) U.S. Cl.
CPC ..... *A42B 3/222* (2013.01); *A42B 3/226* (2013.01)

(58) Field of Classification Search
CPC ..... A42B 3/222; A42B 3/226; A42B 3/0406; A42B 3/22; A42B 3/24
USPC ..... 2/6.3, 6.5, 424, 414, 15
See application file for complete search history.

(56) References Cited

U.S. PATENT DOCUMENTS 4,297,747 A * 11/1981 Nava ..... A42B 3/224 2/424
9,032,548 B2 * 5/2015 Isobe ..... A42B 3/226 2/6.3
9,167,861 B2 * 10/2015 Gafforio ..... A42B 3/226
2008/0028501 A1 * 2/2008 Schimpf ..... A42B 3/224 2/424
2013/0191976 A1 * 8/2013 Pizzi ..... A42B 3/22 2/424

FOREIGN PATENT DOCUMENTS

JP 2013028872 A 2/2013
JP 2013036158 A 2/2013

* cited by examiner

*Primary Examiner* — Katherine M Moran
(74) *Attorney, Agent, or Firm* — Cantor Colburn LLP

(57) ABSTRACT

A helmet includes an operation mechanism, which is accommodated in an accommodation portion, on an outer shell of the helmet for operating an anti-glare visor with a transmission cable. One wall surface at an end of the accommodation portion in an operation direction defines an end surface including an insertion hole extending through the outer shell for passage of the transmission cable.

7 Claims, 6 Drawing Sheets

HELMET

CROSS-RELATED APPLICATIONS AND FOREIGN PRIORITY

This application claims priority to Japanese Patent Application No. 2018-088176, which was filed on May 1, 2018, the content of which is incorporated herein by reference in its entirety.

BACKGROUND ART

The present invention relates to a helmet that includes an anti-glare visor.

An anti-glare visor that is included in a helmet decreases the intensity of light entering the field of view of a wearer to reduce glare. A mechanism that supports the anti-glare visor allows the anti-glare visor to be pivoted between a non-anti-glare position and an anti-glare position. The anti-glare visor in the anti-glare position is in the field of view of the wearer, and the anti-glare visor in the non-anti-glare position is out of the field of view of the wearer. A mechanism that operates the anti-glare visor moves the anti-glare visor between the non-anti-glare position and the anti-glare position when operated by the wearer. The mechanism that operates the anti-glare visor includes a sliding member that is movable along an outer surface of an outer shell of the helmet. The mechanism that supports the anti-glare visor is connected to the sliding member by transmission cables. The transmission cables are arranged inside the outer shell to transmit the movement of the sliding member to the mechanism that supports the anti-glare visor (for example, refer to Japanese Laid-Open Patent Publication Nos. 2013-28872 and 2013-36158). For example, the sliding member is lowered to raise the anti-glare visor to the non-anti-glare position with the transmission cables. Further, the sliding member is raised to lower the anti-glare visor to the anti-glare position with the transmission cables.

The mechanism that operates the anti-glare visor is fitted in a coupling hole, which extends through the outer shell, and positioned relative to the outer shell. The mechanism that operates the anti-glare visor has a mechanical strength that is not as high as the outer shell. The coupling hole extending through the outer shell reduces the mechanical strength of the outer shell. This consequently decreases the mechanical strength of the helmet. Further, the coupling hole is located in the proximity of an ear of the wearer. Thus, noise produced when riding a vehicle directly reaches the ear of the wearer. In this regard, there is still room for improvement of such a helmet from the viewpoint of mechanical strength and quietness of the helmet.

SUMMARY OF THE INVENTION

One object of the present invention is to provide a helmet with improved mechanical strength and quietness.

A helmet that achieves the above object includes an anti-glare visor, an outer shell, an operation mechanism, a support mechanism, a transmission cable, and an accommodation portion. The anti-glare visor decreases the intensity of light. The outer shell includes a front surface having an opening. The operation mechanism includes a sliding member movable between a first operation position and a second operation position along an outer surface of the outer shell in an operation direction. The support mechanism is fixed to the outer shell, and supports the anti-glare visor so that the anti-glare visor is pivotal between an anti-glare position and a non-anti-glare position. The transmission cable connects the sliding member and the support mechanism. Further, the transmission cable transmits an operation force directed toward the first operation position to the support mechanism and pivots the anti-glare visor to the anti-glare position, and the transmission cable transmits an operation force directed toward the second operation position to the support mechanism and pivots the anti-glare visor to the non-anti-glare position. The accommodation portion accommodates the operation mechanism, and is located in the outer surface and defined by a recess including a closed bottom and extending in the operation direction of the operation mechanism The recess includes wall surfaces that intersect with the outer surface of the outer shell, and one of the wall surfaces located at an end of the accommodation portion in the operation direction defines an end surface including an insertion hole that extends through the outer shell for passage of the transmission cable.

EMBODIMENTS OF THE INVENTION

A helmet in accordance with one embodiment will now be described with reference to FIGS. 1 to 9.

Figure 1:
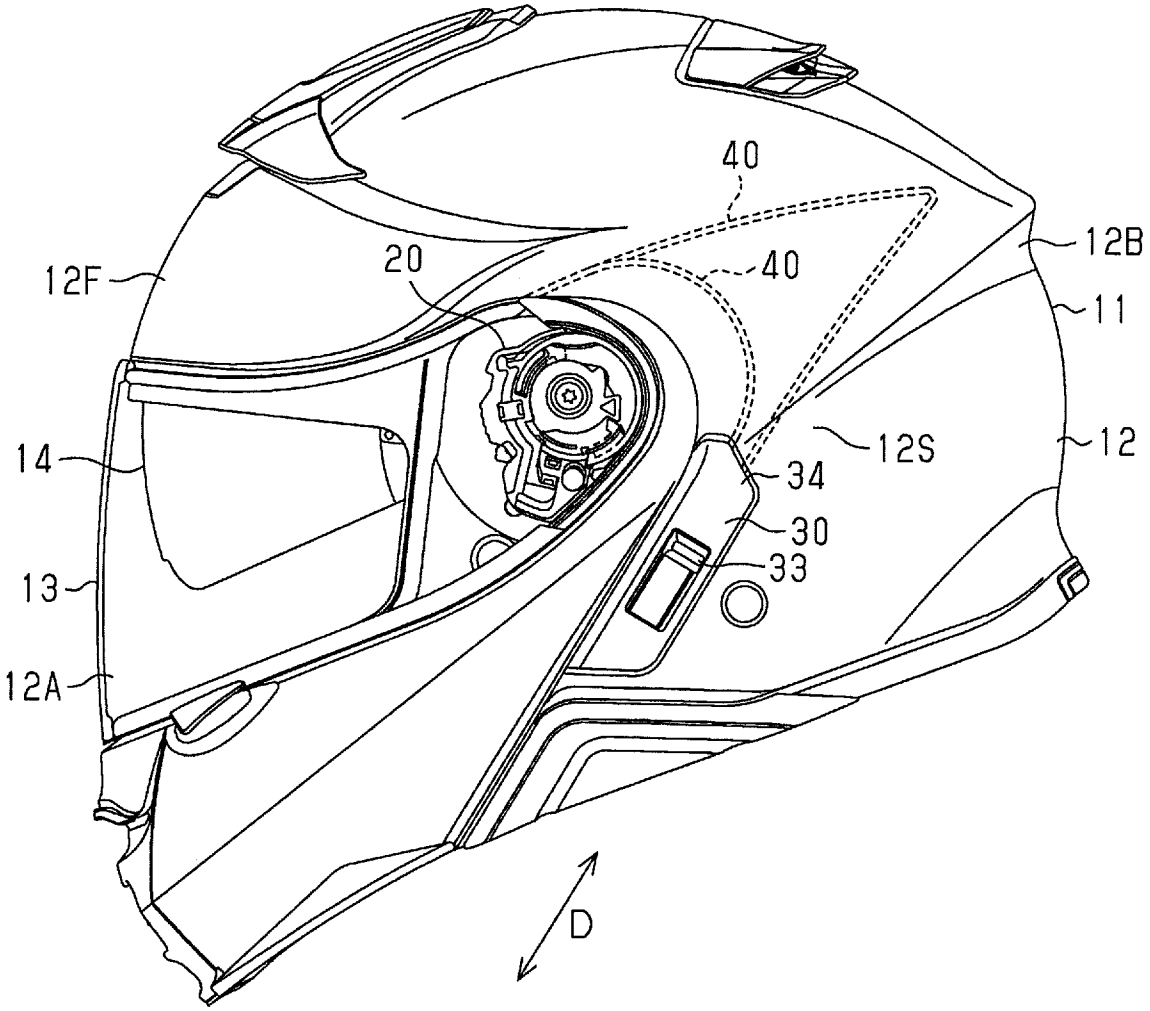
FIG. 1 is a side view showing an outer structure of a helmet in accordance with one embodiment.

As shown in FIG. 1, the helmet includes a spherical helmet body 11, a shield 13, an anti-glare visor 14, a pair of support mechanisms 20, an operation mechanism 30, and a pair of transmission cables 40. In the description hereafter, as viewed in FIG. 1, the side of the shield 13 relative to the anti-glare visor 14 will be referred to as the front side, and the direction in which the left and right support mechanisms 20 are arranged will be referred to as the sideward direction.

The support mechanisms 20, namely, the left support mechanism 20 and the right support mechanism 20, and the single operation mechanism 30 are fixed to an outer shell 12 of the helmet body 11. The support mechanisms 20 are respectively connected by the transmission cables 40 to the single operation mechanism 30.

The outer shell 12 is the outermost shell of the helmet body 11. The material forming the outer shell 12 is, for example, one selected from acrylonitrile-butadiene-styrene copolymer (ABS), polycarbonate (PC), and a thermosetting resin impregnated with reinforcement fibers. A front surface 12F of the outer shell 12 includes an opening 12A that opens toward the front side. The opening 12A provides the field of view for the wearer.

The shield 13 is a transparent plate that is colorless and light permeable. The shield 13 is pivotally supported by the left and right support mechanisms 20. The shield 13 is moved by an operation force between an open position and a close position. The open position is where the shield 13 opens the opening 12A. The close position, as shown in FIG. 1, is where the shield 13 closes the opening 12A. At the close position, the shield 13 prevents foreign matter and wind from entering the front of the helmet body 11 and improves the visibility of the wearer. The material forming the shield 13 is, for example, polycarbonate.

The anti-glare visor 14 is a transparent plate that is colored and light permeable. The anti-glare visor 14 is pivotally supported by the left and right support mechanisms 20. The anti-glare visor 14 is located inside the outer shell 12 inward from the shield 13. An operation force that operates the anti-glare visor 14 is transmitted from the operation mechanism 30 through the transmission cables 40 to each of the support mechanisms 20. The anti-glare visor 14 is moved by the operation force between an anti-glare position and a non-anti-glare position.

The anti-glare position, as shown in FIG. 1, is where the anti-glare visor 14 is located inside the field of view of the wearer covering a portion of the opening 12A. The non-anti-glare position is where the anti-glare visor 14 is located outside the field of view of the wearer completely opening the opening 12A. The anti-glare visor 14, when located at the anti-glare position, decreases the intensity of light and reduces distortion and the like that would decrease the visibility of the wearer. The material forming the anti-glare visor 14 is, for example, polycarbonate. The anti-glare visor 14 may include a hard coat layer that has an antifogging effect.

The two support mechanisms 20 hold the shield 13 in place when the shield 13 is not operated. Further, the two support mechanisms 20 hold the anti-glare visor 14 in place when the anti-glare visor 14 is not operated. More specifically, the two support mechanisms 20 hold the shield 13 in place when the shield 13 has been moved to the open position until the shield 13 is operated next. The two support mechanisms 20 hold the shield 13 in place when the shield 13 has been moved to the close position until the shield 13 is operated next. Further, the two support mechanisms 20 hold the anti-glare visor 14 in place when the anti-glare visor 14 has been moved to the anti-glare position until the anti-glare visor 14 is operated next. The two support mechanisms 20 hold the anti-glare visor 14 in place when the anti-glare visor 14 has been moved to the non-anti-glare position until the anti-glare visor 14 is operated next.

The operation mechanism 30 includes an outer cover 34, and a sliding member 33, part of which is exposed from the outer cover 34. The outer cover 34, together with the outer shell 12, configures the outer surface of the helmet body 11. The sliding member 33 receives the operation force from the wearer for operating the anti-glare visor 14. The operation force moves the sliding member 33 between a first operation position and a second operation position in an operation direction D.

The first operation position is the highest position within a moving range of the sliding member 33. The second operation position is the lowest position within the moving range of the sliding member 33. The outer surface of the outer shell 12 includes a left surface 12S, which is one example of an outer wall surface of the outer shell 12. The operation direction D extends along the left surface 12S of the outer shell 12. Further, the operation direction D extends obliquely toward an upper rear side of the helmet and a lower front side of the helmet.

Each transmission cable 40 is a wire cable that holds an inner cable inside an outer cable. The transmission cables 40 respectively transmit the operation force received by the single sliding member 33 to the support mechanisms 20. Each transmission cable 40 transmits the operation force, which moves the sliding member 33 to the first operation position, to the separate support mechanisms 20 in order to pivot the single anti-glare visor 14 to the anti-glare position. Further, each transmission cable 40 transmits the operation force, which moves the sliding member 33 to the second operation position, to the separate support mechanisms 20 in order to pivot the single anti-glare visor 14 to the non-anti-glare position.

The left transmission cable 40 passes through a path including an arc that extends around the left support mechanism 20 at the inner side of the left surface 12S of the outer shell 12. The operation direction D is a tangential direction at one end of the arc. The right transmission cable 40 is laid out inside the outer shell 12 from the operation mechanism 30 toward a rear surface 12B of the helmet and then toward the right support mechanism 20.

Figure 2:
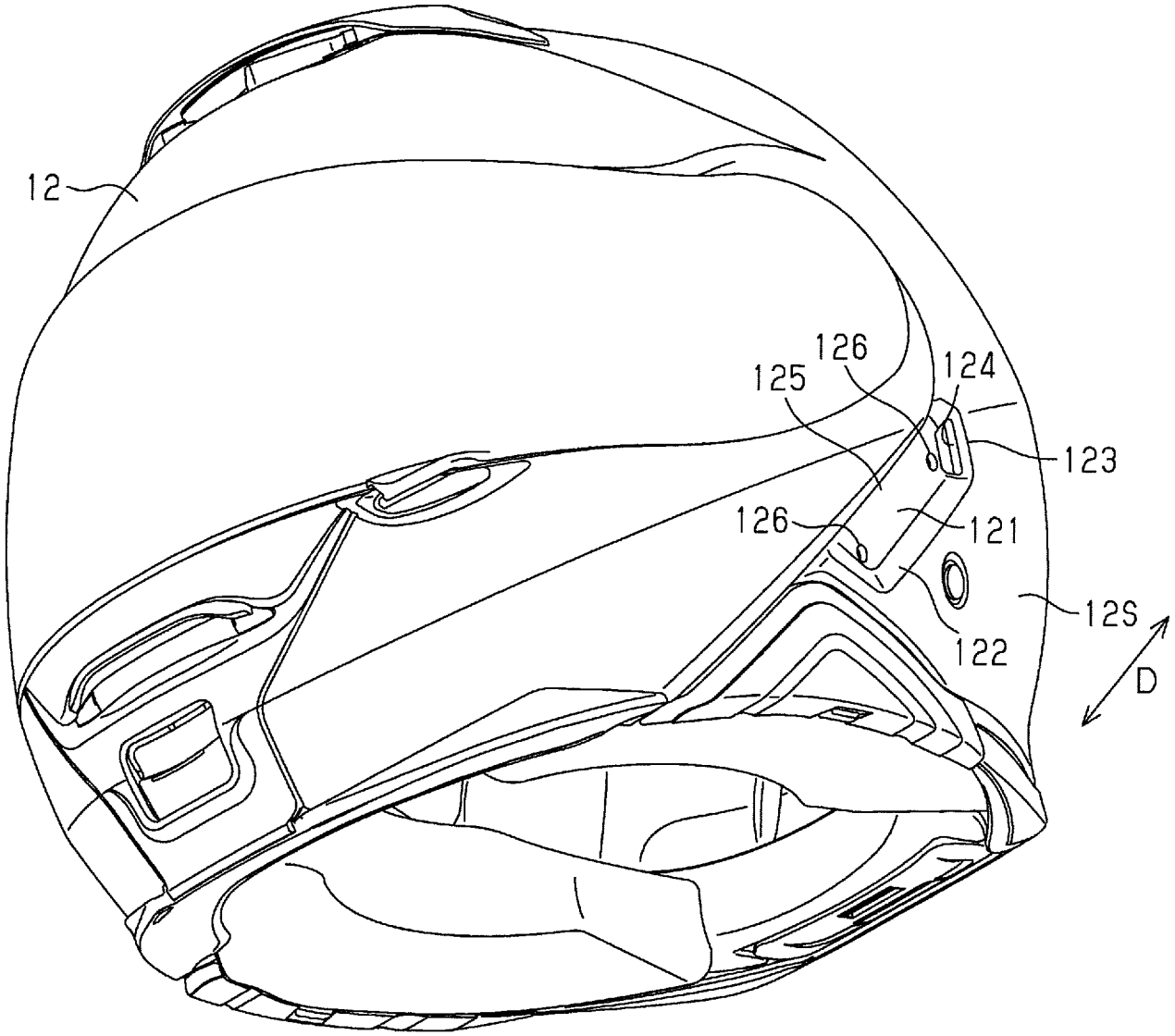
FIG. 2 is a perspective view of the helmet shown in FIG. 1 as viewed from a lower front side in a state in which an operation mechanism is removed from the helmet.

As shown in FIG. 2, the left surface 12S of the outer shell 12 includes an accommodation portion 121 that accommodates the operation mechanism 30. The accommodation portion 121 is defined by a recess that includes a closed bottom and extends in the operation direction D. The accommodation portion 121 includes wall surfaces 122 and a bottom surface 125 of the recess. The wall surfaces 122 of the accommodation portion 121 are formed by inclined planes that intersect with the left surface 12S of the outer shell 12. The bottom surface 125 of the recess is a surface (end surface) that extends along part of the left surface 12S of the outer shell 12. The bottom surface 125 of the accommodation portion 121 includes a screw hole 126 extending through the bottom surface 125 at each of the two ends in the operation direction D.

The wall surfaces 122 of the accommodation portion 121 include two end surfaces that are located at the two ends of the accommodation portion 121 in the operation direction D. The upper one of the two end surfaces, namely, the upper end surface 123 includes an insertion hole 124 that extends through the outer shell 12. The accommodation portion 121 is in communication with the inside of the outer shell 12 through the insertion hole 124 in the operation direction D. The two transmission cables 40 are pulled from the accommodation portion 121 through the insertion hole 124 and drawn into the outer shell 12 in the operation direction D.

The helmet body 11 includes an inner shell configuring the innermost shell arranged inside the outer shell 12. The material forming the inner shell is a resin material that absorbs impact, for example, one selected from polyurethane and polystyrene foam resin. The two transmission cables 40 are located between the outer shell 12 and the inner shell.

Figure 4:
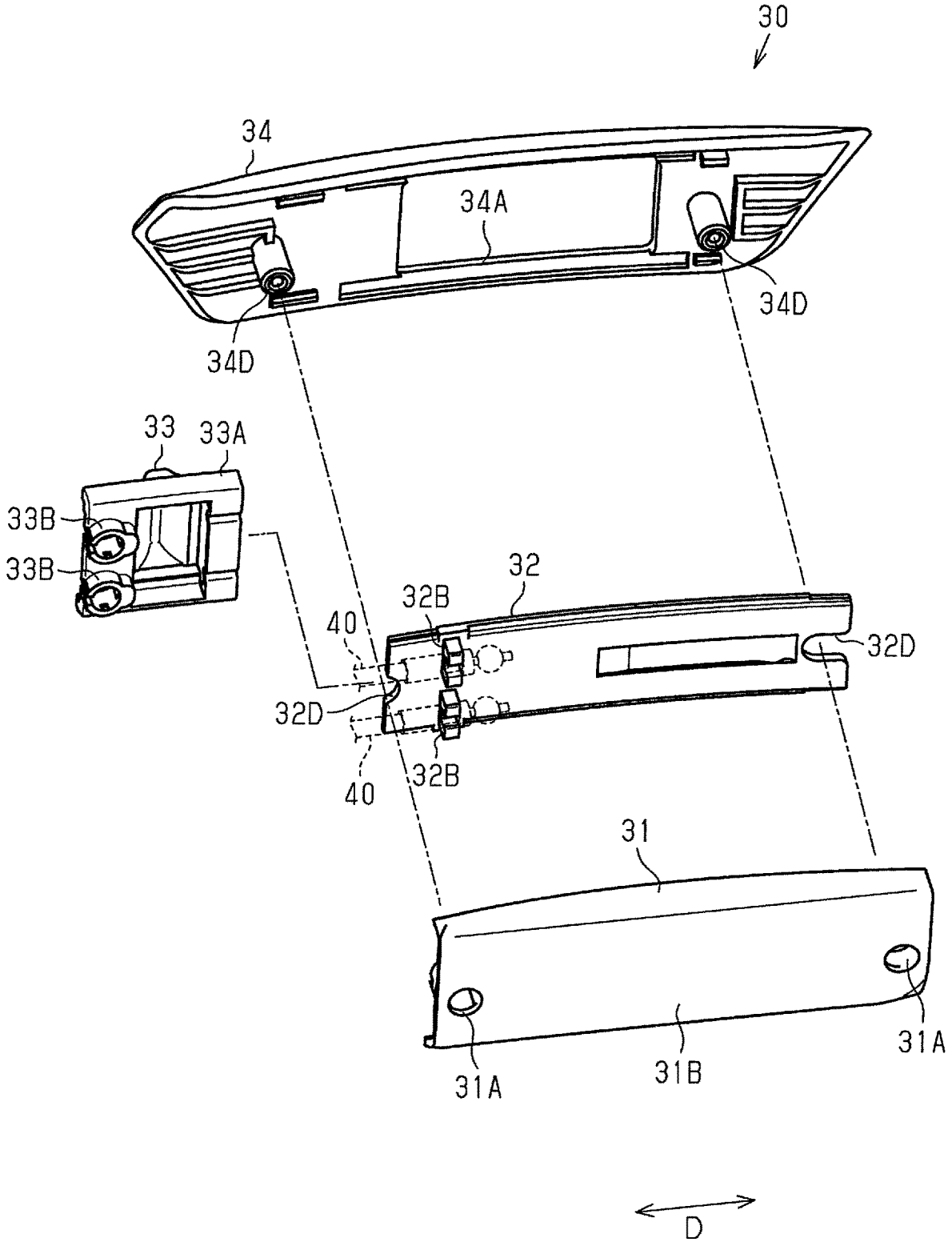
FIG. 4 is an exploded perspective view of the operation mechanism taken from a side opposite to FIG. 3.
Figure 5:
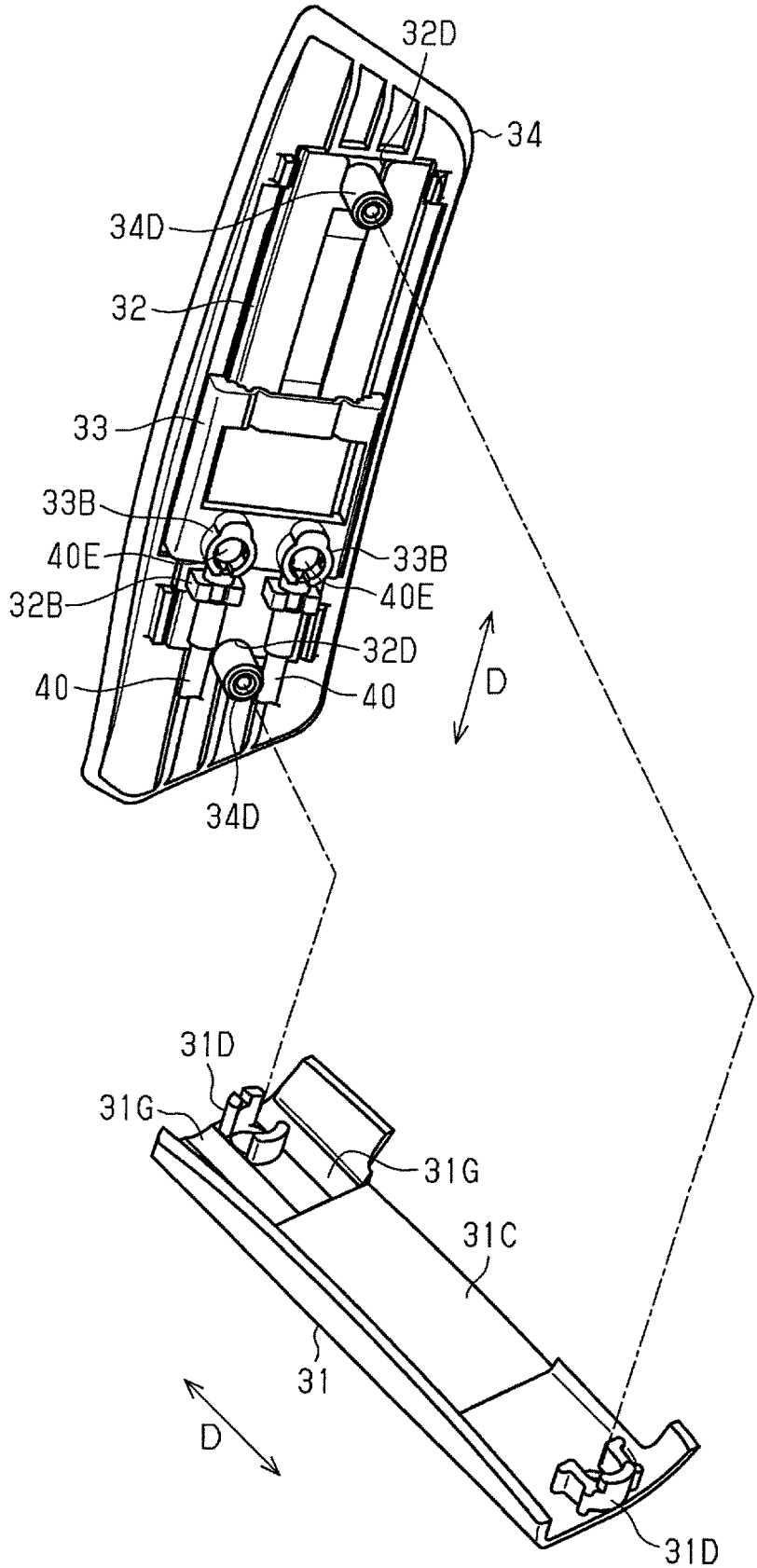
FIG. 5 is an exploded perspective view of an inner structure of the operation mechanism in the helmet of FIG. 1 shown together with transmission cables.

The structure of the operation mechanism 30 will now be described with reference to FIGS. 3 to 5.

Figure 3:
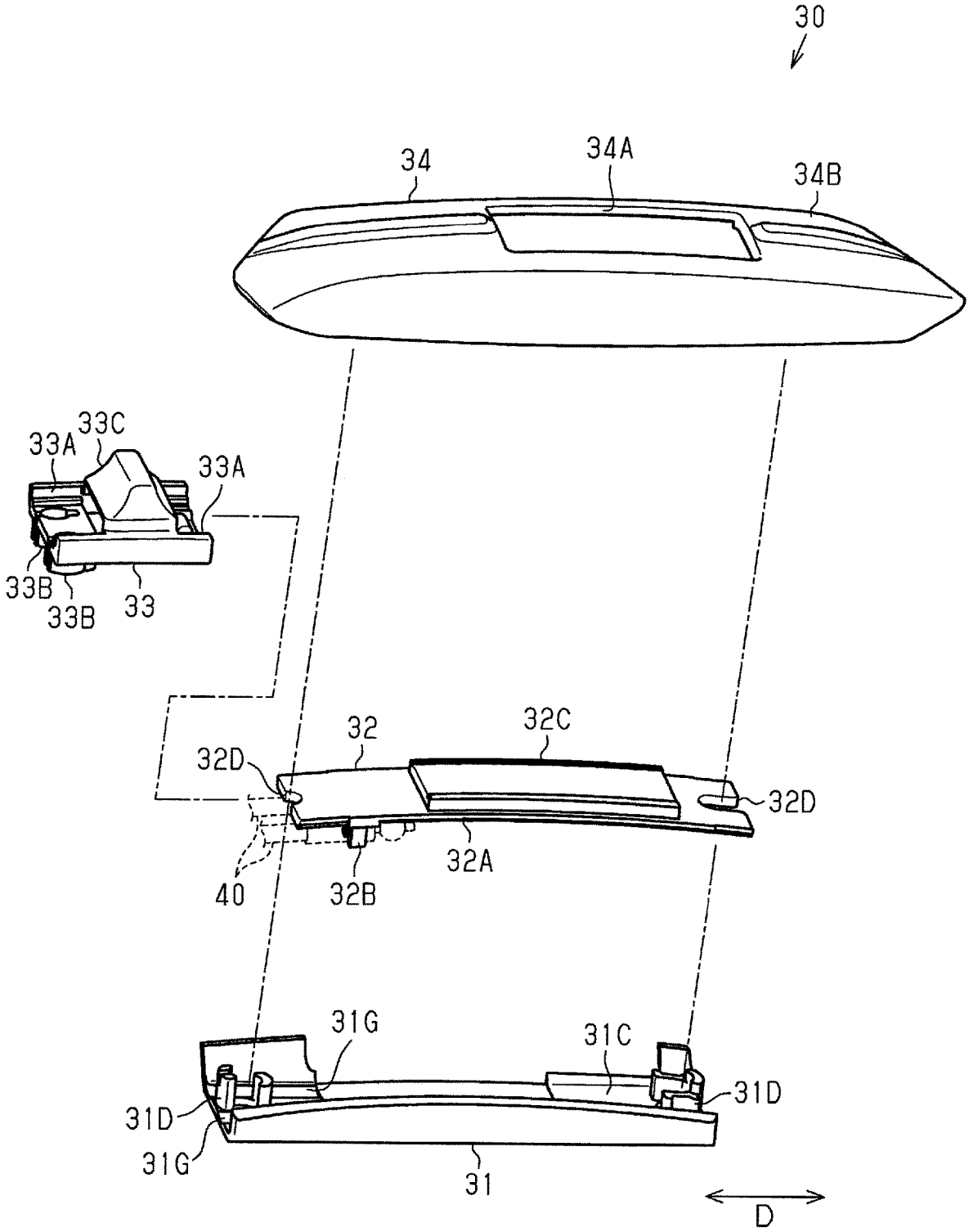
FIG. 3 is an exploded perspective view of the operation mechanism.

As shown in FIG. 3, the operation mechanism 30 includes an inner cover 31, a guide member 32, the sliding member 33, and the outer cover 34.

The inner cover 31 has the form of a plate that extends in the operation direction D. The inner cover 31 is arranged inside the accommodation portion 121 and combined with the transmission cables 40, the guide member 32, and the sliding member 33. The inner cover 31 extends in the operation direction D along the full length of the bottom surface 125 of the accommodation portion 121.

The inner cover 31 includes two ends, namely a lower end and an upper end, in the operation direction D, and each end includes a fastening hole 31A (refer to FIG. 4) that extends through the inner cover 31. The surface of the inner cover 31 that opposes the bottom surface 125 of the accommodation portion 121 is a contact surface 31B (refer to FIG. 4). The contact surface 31B of the inner cover 31 is fastened by screws to the bottom surface 125 of the accommodation portion 121 in order to contact most of the bottom surface 125 of the accommodation portion 121.

The inner cover 31 includes a guide surface 31C that opposes the guide member 32 and the transmission cables 40. The guide surface 31C includes a pair of lead grooves 31G (refer to FIG. 5) that extend in the operation direction D. Each lead groove 31G is large enough to accommodate part of the corresponding transmission cable 40. One end of each lead groove 31G serves as an entrance end for the corresponding transmission cable 40 and opposes the insertion hole 124 in the accommodation portion 121. The other end of each lead groove 31G serves as an exit end for the corresponding transmission cable 40 and opposes the middle of the inner cover 31 in the operation direction D. Each lead groove 31G guides and extends the corresponding transmission cable 40 in the operation direction D.

The inner cover 31 includes a pair of fitting projections 31D on the guide surface 31C. Each fitting projection 31D projects from the guide surface 31C toward the outer cover 34 and surrounds one of the fastening holes 31A. A screw used to fix the inner cover 31 to the accommodation portion 121 is inserted through each screw hole 126 in the outer shell 12, the corresponding fastening hole 31A in the inner cover 31, and the corresponding fitting projection 31D on the inner cover 31.

The guide member 32 has the form of a rectangular plate that extends in the operation direction D. The guide member 32 is arranged between the inner cover 31 and the outer cover 34. The guide member 32 includes guide edges 32A that extend in the operation direction D. The guide edges 32A are engaged with the sliding member 33 to guide the movement of the sliding member 33 in the operation direction D.

The guide member 32 includes a pair of ends in the operation direction D, and each end includes a fitting groove 32D that extends in the operation direction D. Each fitting projection 31D on the inner cover 31 is fitted into one of the fitting grooves 32D to position the guide member 32 on the inner cover 31.

The guide member 32 includes a pair of fastening portions 32B projecting toward the inner cover 31. The outer cable of each transmission cable 40 includes a distal end fastened to one of the fastening portions 32B. The fastening portions 32B oppose the exit ends of the lead grooves 31G, respectively. The fastening portions 32B hold the ends of the outer cables at the exit ends of the lead grooves 31G, respectively.

The guide member 32 includes a positioning projection 32C that projects toward the outer cover 34. The positioning projection 32C has the form of a rectangular plate that extends in the operation direction D.

The sliding member 33 includes a main body that is U-shaped as viewed in the operation direction D. The main body of the sliding member 33 includes a pair of sliding pieces 33A sandwiching the guide member 32 and extending in the operation direction D. The main body of the sliding member 33 includes a pair of fastening portions 33B that project toward the inner cover 31 (refer to FIG. 4). The inner cable of each transmission cable 40 includes an end 40E fastened to one of the fastening portions 33B (refer to FIG. 5).

The sliding member 33 includes an operation tab 33C that extends across both sliding pieces 33A. The guide member 32 is inserted between the main body of the sliding member 33 and the operation tab 33C (refer to FIG. 5). The sliding pieces 33A slide along the guide edges 32A of the guide member 32 so that the sliding member 33 moves in the operation direction D relative to the guide member 32. When the sliding member 33 moves, the guide member 32 guides the movement of the sliding member 33 in the operation direction D. Further, each fastening portion 33B moves the inner cable in the operation direction D relative to the outer cable.

The outer cover 34 has the form of a plate that extends in the operation direction D. The outer cover 34 covers the inner cover 31 and the guide member 32 from the outer side of the helmet. The outer cover 34 includes a surface 34B that is large enough to entirely cover the accommodation portion 121 and smoothly connects to the left surface 12S of the outer shell 12.

The outer cover 34 includes a rectangular fitting hole 34A that extends in the operation direction D. The fitting hole 34A in the outer cover 34 is fitted to the positioning projection 32C of the guide member 32 to position the guide member 32 relative to the outer cover 34. The fitting hole 34A in the outer cover 34 exposes the operation tab 33C of the sliding member 33 to the outside of the outer cover 34. The fitting hole 34A in the outer cover 34 allows the operation tab 33C to move in the operation direction D.

The outer cover 34 includes a pair of fitting tubes 34D that project toward the inner cover 31. The fitting tubes 34D are respectively fitted into the fitting projections 31D on the inner cover 31 (refer to FIG. 5). Further, the fitting tubes 34D are respectively inserted into the fastening holes 31A in the inner cover 31 and fastened by screws to the outer shell 12 with the corresponding screw holes 126 in the outer shell 12.

Operation

Figure 6:
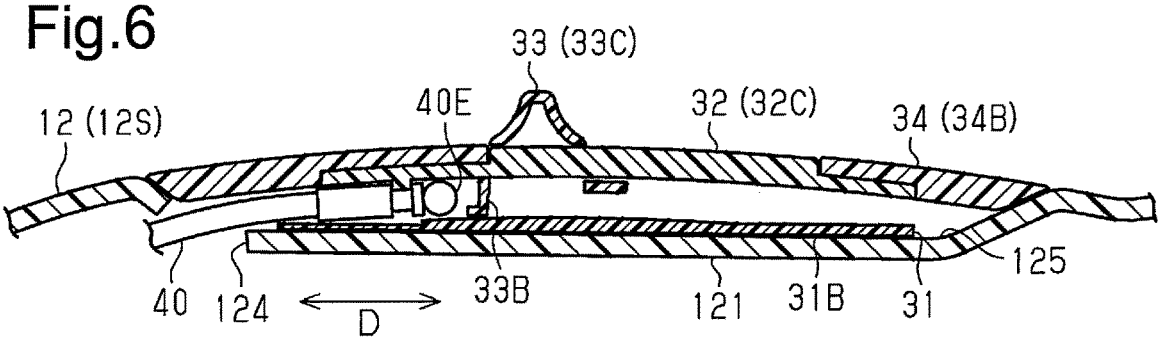
FIG. 6 shows a state in which a sliding member of the operation mechanism in the helmet of FIG. 1 is located at a first operation position.
Figure 7:
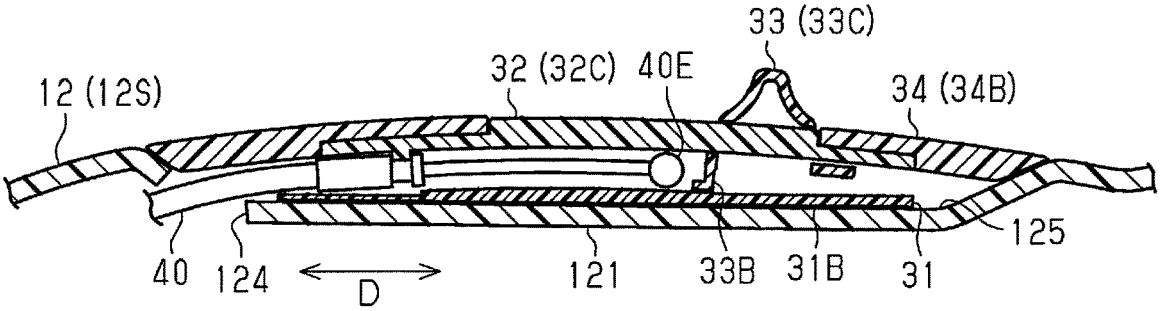
FIG. 7 shows a state in which the sliding member of the operation mechanism in the helmet of FIG. 1 is located at a second operation position.
Figure 8:
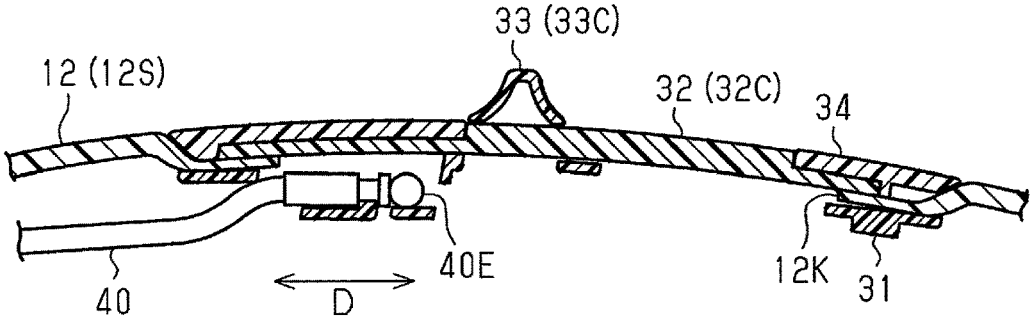
FIG. 8 shows a state in which the sliding member of the operation mechanism in a reference example is located at the first operation position.
Figure 9:
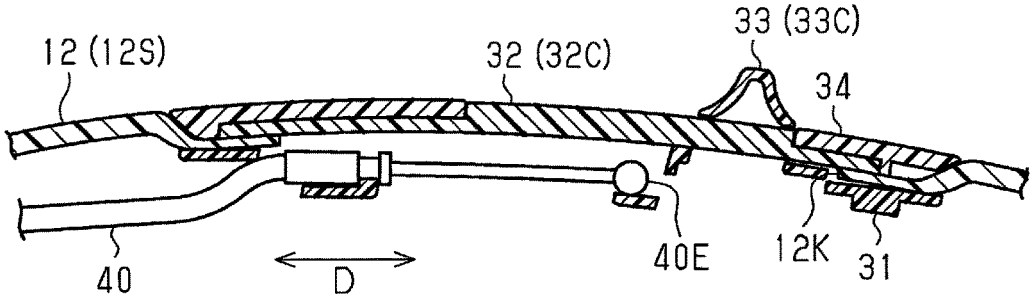
FIG. 9 shows a state in which the sliding member of the operation mechanism in the reference example is located at the second operation position.

The operation of the helmet will now be described with reference to FIGS. 6 to 9. FIG. 6 shows the operation mechanism 30 when the operation tab 33C is located at the first operation position, and FIG. 7 shows the operation mechanism 30 when the operation tab 33C is located at the second operation position. Further, FIG. 8 shows the operation mechanism 30 of a reference helmet when the operation tab 33C is located at the first operation position, and FIG. 9 shows the operation mechanism 30 of the reference helmet when the operation tab 33C is located at the second operation position.

The reference helmet is an example in which the outer shell 12 does not include the accommodation portion 121 with the closed bottom. Further, the reference helmet includes a fitting hole 12K that extends through the outer shell 12 along the entire moving range of the operation tab 33C in the left surface of the outer shell 12. The operation mechanism 30 is fitted into the fitting hole 12K.

As shown in FIG. 6, the surface 34B of the outer cover 34 smoothly connects to the left surface 12S of the outer shell 12. Thus, the operation mechanism 30 appears as if it is integral with the outer shell 12.

When the operation tab 33C is located at the first operation positon, the fastening portions 33B of the sliding member 33 are aligned with the insertion hole 124 in the outer shell 12 along a straight line that extends in the operation direction D of the sliding member 33. In this case, the transmission cables 40, which are connected to the sliding member 33, extend substantially straight from the ends 40E of the inner cables in the operation direction D of the sliding member 33. Accordingly, the transmission cables 40, which are connected to the sliding member 33, have no bent sections having an extremely small radius of curvature in and near the operation mechanism 30. Thus, the transmission cables 40 can be smoothly drawn from the operation mechanism 30.

As shown in FIG. 7, when the operation tab 33C is moved to the second operation position, the fastening portions 33B of the sliding member 33 remain aligned with the insertion hole 124 of the outer shell 12 along the straight line that extends in the operation direction D of the sliding member 33. In this case, the movement of the operation tab 33C draws the inner cables out of the outer cables. As a result, when the operation tab 33C is moved from the first operation position to the second operation position, the inner cables are smoothly moved in the operation direction D thereby allowing for smooth movement of the operation tab 33C. When the operation tab 33C is moved from the second operation position to the first operation position, the inner cables are also smoothly moved in the operation direction D thereby allowing for smooth movement of the operation tab 33C.

The accommodation portion 121, which accommodates the operation mechanism 30, is a recess having a bottom closed by the bottom surface 125. Further, the insertion hole 124, which extends through the outer shell 12, is not a large hole used to allow for displacement of the sliding member 33. Rather, the insertion hole 124 is a small hole that is just large enough to allow for passage of the linearly extending transmission cables 40. Additionally, the wall surface 122 that includes the insertion hole 124 intersects with the left surface 12S and controls deformation of the left surface 12S. Thus, when compared with a structure that includes a large opening in the left surface 12S extending along the left surface 12S, this restrains a decrease in the strength of the outer shell 12 that would be caused by the attachment of the operation mechanism 30 and the formation of the insertion hole 124 in the outer shell 12. Further, the insertion hole 124 is small, and the left surface 12S does not include a hole that opens directly toward the ear of the wearer. This reduces the noise that reaches the ear of the wearer when riding a vehicle.

As shown in FIGS. 8 and 9, when the fitting hole 12K extends through the outer shell 12 along the entire moving range of the operation tab 33C in the left surface 12S of the outer shell 12, a large through hole would be located in the proximity of the ear of the wearer. Further, the fitting hole 12K, which is a large through hole, opens toward the ear for the wearer. Thus, noise produced when riding a vehicle will directly reach the ear of the wearer. Further, the fitting hole 12K greatly reduces the strength of the outer shell 12. Additionally, the fastening portions 33B of the sliding member 33 are not aligned with the fitting hole 12K of the outer shell 12 in the operation direction D. Further, the transmission cables 40 are not guided by the lead grooves 31G on the inner cover 31. Thus, the transmission cables 40 will easily form bent sections with an extremely small radius of curvature when moved between the first operation position and the second operation position.

The above embodiment has the following advantages.

(1) The transmission cables 40, which connect the sliding member 33 and the support mechanisms 20, extend from the accommodation portion 121 into the outer shell 12 in the operation direction D of the sliding member 33. As a result, the inner cable of each transmission cable 40 moves smoothly in accordance with the movement of the sliding member 33 without being bent near the operation mechanism 30 and the accommodation portion 121.

(2) The accommodation portion 121, which accommodates the operation mechanism 30, is a recess that includes a closed bottom and extends in the operation direction D. Further, only the upper end surface 123, which is the one of the wall surfaces 122 of the recess and located at the upper end of the accommodation portion 121 in the operation direction D, includes an insertion hole 124. Thus, the hole extending through the outer shell 12 is not a large hole used to displace the sliding member 33, and can be formed as a small hole that only needs to be large enough to allow for passage of the two transmission cables 40.

(3) The wall surfaces 122 of the recess intersect with the left surface 12S and serve to control deformation of the left surface 12S. Further, the upper end surface 123, which is the one of the wall surfaces 122 and located at the upper end of the accommodation portion 121 in the operation direction D, includes the small insertion hole 124. This further restrains decreases in the strength of the outer shell 12 as compared with a structure including a large opening extending in and along the left surface 12S.

(4) The inner cover 31 included in the operation mechanism 30 is in planar contact with substantially the entire bottom surface 125 of the recess, or the accommodation portion 121. Thus, the planar contact of the bottom surface 125 of the accommodation portion 121 with the inner cover 31 restrains deformation of the accommodation portion 121 caused by external forces. Accordingly, the mechanical strength of the accommodation portion 121 is increased by the inner cover 31 of the operation mechanism 30.

(5) The guide surface 31C on the inner cover 31 includes the lead grooves 31G extending in the operation direction D. The lead grooves 31G direct the transmission cables 40 extending from the sliding member 33 toward the insertion hole 124. This restrains bending of the transmission cables 40 inside the operation mechanism 30. As a result, the transmission cables 40 are smoothly moved inside the operation mechanism 30.

(6) The transmission cable 40 extends along an arc around the left support mechanism 20, and the tangential direction of the transmission cable 40 at one end of the arc is the operation direction D. Accordingly, the transmission cable 40 extends between the sliding member 33 and the support mechanism 20 along a path forming a smooth curve that does not include bent sections having an extremely small radius of curvature. This further smoothly moves the transmission cable 40 in the operation direction D.

It should be apparent to those skilled in the art that the present invention may be embodied in many other specific forms without departing from the spirit or scope of the invention. Particularly, it should be understood that the present invention may be embodied in the following forms.

Transmission Cable

The operation direction D may differ from the tangential direction of the path of the transmission cable 40. As described above, as long as the tangential direction of the path of the transmission cable 40 is the same as the operation direction D, advantage (6) can be obtained.

Inner Cover

The lead grooves 31G on the inner cover 31 can be omitted, and the inner cover 31 may include projection ribs that guide the transmission cables 40 in the operation direction D. This also obtains advantage (5).

The sliding member 33 may be spaced apart by a suitable distance (gap) from the bottom surface 125 of the accommodation portion 121 so that the fastening portions 33B and part of the sliding member 33 do not contact the bottom surface 125 of the accommodation portion 121. In such a case, the inner cover can be omitted by increasing the mechanical strength of the operation mechanism 30 with the guide member 32 and the outer cover 34. Such a structure also obtains advantages (4) to (6).

Insertion Hole

The insertion hole 124 may be a single hole so that the two transmission cables 40 pass through the hole together. Alternatively, the insertion hole 124 may be formed by two holes that respectively allow for passage of the transmission cables 40. Further, the insertion hole 124 can be rectangular or round in shape.

The present examples and embodiments are to be considered as illustrative and not restrictive, and the invention is not to be limited to the details given herein, but may be modified within the scope and equivalence of the appended claims.

The invention claimed is:

1. A helmet comprising:

an anti-glare visor that decreases intensity of light;

an outer shell that includes a front surface having an opening;

an operation mechanism that includes a sliding member movable between a first operation position and a second operation position along an outer surface of the outer shell in an operation direction;

a support mechanism fixed to the outer shell, wherein the support mechanism supports the anti-glare visor so that the anti-glare visor is pivotal between an anti-glare position and a non-anti-glare position;

a transmission cable connected to the sliding member and the support mechanism, wherein the transmission cable transmits an operation force directed toward the first operation position to the support mechanism and pivots the anti-glare visor to the anti-glare position, and the transmission cable transmits an operation force directed toward the second operation position to the support mechanism and pivots the anti-glare visor to the non-anti-glare position; and an accommodation portion that accommodates the operation mechanism, wherein the accommodation portion is located in the outer surface and defined by a recess including a closed bottom and extending in the operation direction, and the recess includes wall surfaces that intersect with the outer surface of the outer shell, and one of the wall surfaces located at an end of the accommodation portion in the operation direction defines an end surface including an insertion hole that extends through the outer shell for passage of the transmission cable.

2. The helmet according to claim 1, wherein the operation mechanism further includes an inner cover that covers the transmission cable and the sliding member from an inner side of the recess, and the inner cover has a form of a plate and is fixed to a bottom surface of the recess in planar contact with the bottom surface extending along a full length of the bottom surface of the recess in the operation direction.

3. The helmet according to claim 2, wherein the inner cover includes a guide surface opposing the transmission cable at a side opposite to a surface that is in planar contact with the bottom surface of the recess, and the guide surface includes a lead groove that guides the transmission cable between the sliding member and the insertion hole in the operation direction.

4. The helmet according to claim 1, wherein the operation mechanism further includes a guide member inside the recess, and the guide member extends in the operation direction and guides movement of the sliding member in the operation direction.

5. The helmet according to claim 4, wherein the operation mechanism further includes an outer cover that covers the guide member from an outer side of the helmet and exposes the sliding member to the outer side through a hole extending through the outer cover, and the outer cover includes a surface that entirely covers the accommodation portion and smoothly connects to the outer surface.

6. The helmet according to claim 1, wherein the transmission cable passes through a path including an arc that extends around the support mechanism inside the outer shell, and the operation direction is a tangential direction at an end of the arc.

7. A helmet comprising:

an anti-glare visor that decreases intensity of light;

an outer shell that includes a front surface having an opening;

an operation mechanism that includes a sliding member movable between a first operation position and a second operation position along an outer surface of the outer shell in an operation direction;

a support mechanism fixed to the outer shell, wherein the support mechanism supports the anti-glare visor so that the anti-glare visor is pivotal between an anti-glare position and a non-anti-glare position;

a transmission cable connected to the sliding member and the support mechanism, wherein the transmission cable transmits an operation force directed toward the first operation position to the support mechanism and pivots the anti-glare visor to the anti-glare position, and the transmission cable transmits an operation force directed toward the second operation position to the support mechanism and pivots the anti-glare visor to the non-anti-glare position; and an accommodation portion that accommodates the operation mechanism, wherein the accommodation portion is located in the outer surface and defined by a recess including a closed bottom and extending in the operation direction, and the recess includes wall surfaces that intersect with the outer surface of the outer shell, and one of the wall surfaces located at an end of the accommodation portion in the operation direction defines an end surface including an insertion hole that extends through the outer shell for passage of the transmission cable, wherein the operation mechanism further includes an inner cover that covers the transmission cable and the sliding member from an inner side of the recess, the inner cover includes a guide surface opposing the transmission cable, and the guide surface includes a lead groove extending in the operation direction to guide the transmission cable from the sliding member toward the insertion hole.

* * * * *